United States Patent [19]

Bonchek

[11] Patent Number: 5,027,617

[45] Date of Patent: Jul. 2, 1991

[54] DUAL RING WITH PROTECTOR

[76] Inventor: Kenneth H. Bonchek, 116 82nd Avenue, Kew Gardens, N.Y. 11415

[21] Appl. No.: 486,077

[22] Filed: Feb. 28, 1990

[51] Int. Cl.[5] ..... A44C 9/00

[52] U.S. Cl. ..... 63/15.3; 63/15.1

[58] Field of Search ..... 63/15, 15.1, 15.2, 15.3, 63/15.4, 15.7, 15.8, 28

[56] References Cited

U.S. PATENT DOCUMENTS

| | | | |
|---|---|---|---|
| 1,599,811 | 9/1926 | Eliasoff | 63/15.3 |
| 2,029,464 | 2/1936 | Coleman | 63/15.3 |
| 2,151,607 | 3/1939 | Lovell | 63/15.3 |
| 2,262,513 | 11/1941 | Novack | 63/15.2 |
| 2,408,982 | 10/1946 | Koenig | 63/15.3 X |
| 2,761,294 | 9/1956 | Lund | 63/15.2 |

FOREIGN PATENT DOCUMENTS

| | | | |
|---|---|---|---|
| 2226131 | 11/1974 | France | 63/15 |

*Primary Examiner*—Laurie K. Cranmer

*Attorney, Agent, or Firm*—Marmorek, Guttman & Rubenstein

[57] ABSTRACT

A dual ring with protector comprises a pair of rings arranged to be worn together on one finger. One of the pair of rings has an integral protective channel which is adapted to receive the second ring of the pair. The second ring of the pair has ornamentation around its circumference which requires protection from scratching, abrasion, and the possibility that the stones worn facing the inside of the hand will fall out if the gold holding them catches on clothing or hits an object. The protective channel of the first ring is adapted to receive the second ring and protects the complete inner portion, facing the inside of the hand, from wear, scratches, abrasion and the possibility that the stones worn facing the inside of the hand will fall out if the gold holding them catches on clothing or hits an object.

3 Claims, 2 Drawing Sheets

DUAL RING WITH PROTECTOR

BACKGROUND OF THE INVENTION

The invention relates to a dual ring which is generally worn on one finger. More specifically, the invention relates to a pair of rings such as a wedding band and an engagement ring which are generally worn together on one finger.

The engagement ring is generally a plain band with a single ornamental stone, usually a diamond, or at most a cluster of ornamental stones concentrated in a limited portion of the band. Thus, the engagement ring is always worn with the stone portion facing outward.

Generally, the wedding ring comprises a single major band which is worn on the same finger. The band may be gold with an ornamented/engraved surface, or it may include ornamental stones such as diamonds, rubies or emeralds in portions of the periphery of the ring. In some cases, the ring may include front and back arc segments which are different from each other, e.g., one arc segment might contain rubies (red) and an opposite arc segment could be set with emeralds (green). The ring then gives a different appearance depending on whether the ruby arc segment is on the outside of the hand, or the emerald arc segment faces outward.

Thus, it is possible to achieve two different appearances of the dual ring, by wearing either one or the other set of ornamental stones facing outward. However, this entails the necessity of wearing one set of stones facing inward, where the stones are exposed to wear, abrasion, scratching and the possibility that the stones worn facing the inside of the hand will fall out if the gold holding them catches on clothing or hits an object during the course of normal activities carried on by the hand. In addition, it is desirable to have some means of preventing the ring with the stones from inadvertently twisting around the finger so as to expose the set of stones which is intended to be hidden from view.

It is an object of the present invention to provide a dual ring having an integral protector to avoid wear, scratching or abrasion of the ornamental stones which face the palm of the hand and the possibility that the stones worn facing the inside of the hand will fall out if the gold holding them catches on clothing or hits an object. It is a further object of the present invention to provide a means for keeping the band with the ornamental stones in place and prevent it from inadvertently twisting around the finger, as well as keeping the two rings close together in order to prevent skin color from appearing between the two rings.

SUMMARY OF THE INVENTION

The present invention is directed to a pair of rings which are generally worn together. One of the rings, for example, an engagement ring, has ornamentation at only one point on its circumference, so that it is always worn with that point facing the outside of the hand. The other ring of the pair, for example, a wedding band, is ornamented around sections of its circumference so that when it is worn, some of the ornamentation faces the inside of the hand where it is exposed to wear and scratching and the possibility that the stones worn facing the inside of the hand will fall out if the gold holding them catches on clothing or hits an object in the course of ordinary daily activities.

According to the present invention, the first ring of the pair comprises a main band having an integral protector, which is adapted to be worn on the finger always in the same position. This would be the case of a ring such as an engagement ring which has ornamentation at only one point on the circumference of the ring. Thus, the ring is always worn with the ornamentation facing outward. According to the present invention, this ring is equipped with an integral channel segment opposite to the ornamentation point of the ring so that the channel is on the inside of the hand, and is dimensioned to receive the second ring of the pair. The second ring of the pair is, for example, a wedding band, which carries ornamentation around arc segments of its outer circumference. For instance, the wedding band may have sets of precious stones on portions of its circumference or around its entire circumference. In one embodiment, the wedding band may have one type of precious stones on one part of the circumference and another type of precious stones on an opposite part of the circumference so as to give a different appearance depending on which part of the ring faces outward. In any case, all the stones which face the inside of the hand are encased in the protective channel which is integral with the first ring so that they are protected from abrasion and scratching which may occur in the normal use of the hand and the possibility that the stones worn facing the inside of the hand will fall out if the gold holding them catches on clothing or hits an object. Furthermore, depending on the shape and snugness of the protective channel, it can operate to keep the rings stable and together so that the wedding band will not inadvertently twist around, and so that no skin color will be visible in the space between the rings.

DETAILED DESCRIPTION OF A PREFERRED EMBODIMENT

Figure 1:
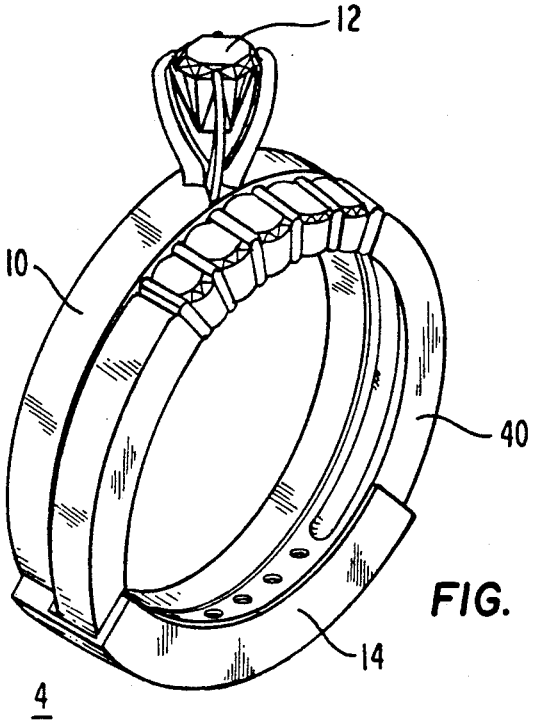
FIG. 1 is a perspective view of the dual ring.

Referring to the drawings, a dual ring 4 according to the invention is illustrated. The dual ring comprises an ornamented band 40 and a ring 10 having a single ornament 12 and a protective channel 18. Ring 40 fits into the protective channel 18 of ring 10.

Figure 2:
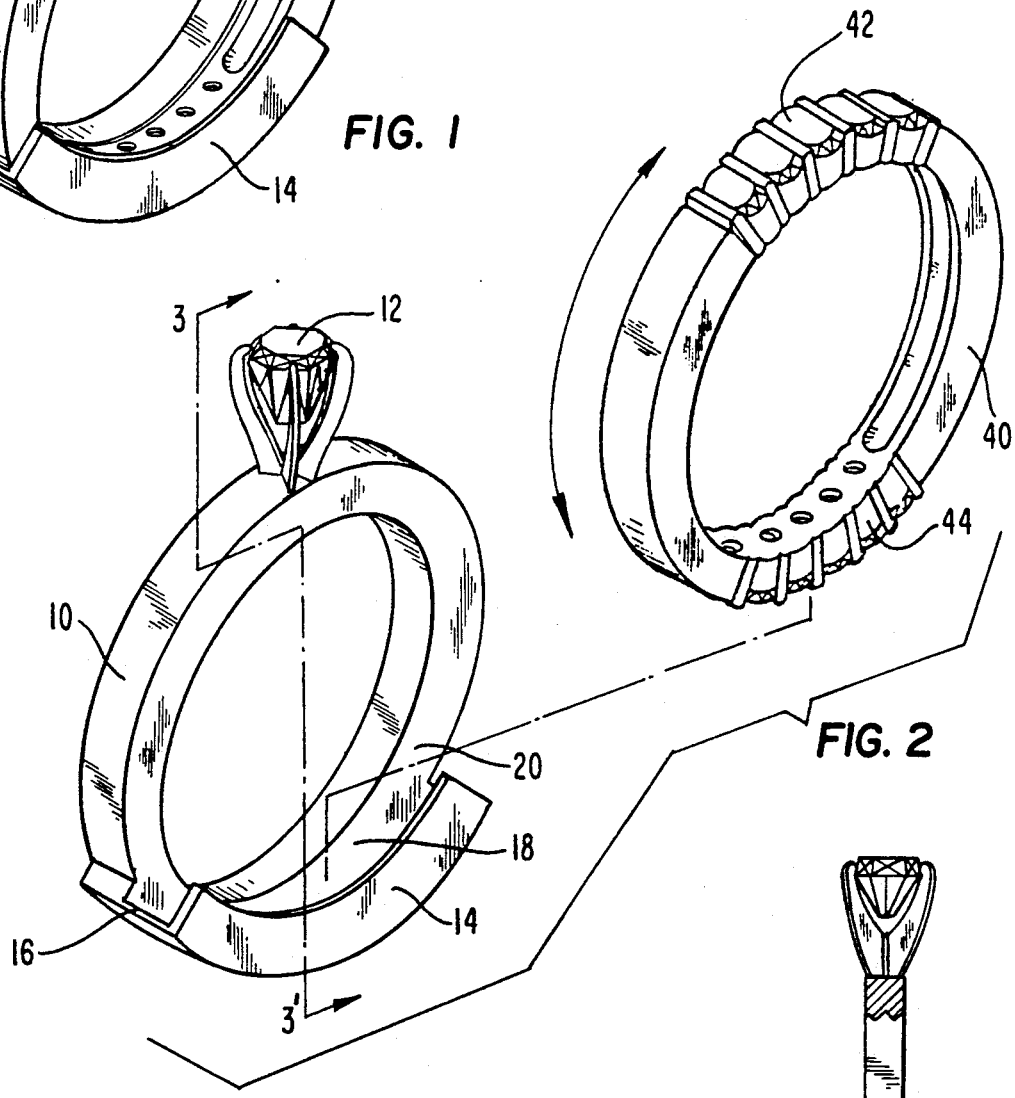
FIG. 2 is an exploded drawing showing how one ring fits into the protective channel of the second ring.
Figure 3:
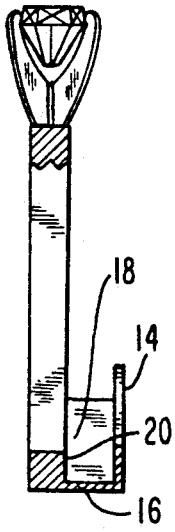
FIG. 3 is a cross-section of the ring having the protective channel.

The exploded drawing in FIG. 2 shows the details of the dual ring. Ring 10 has ornamentation in the form of stone 12 on the portion of the ring which is worn facing outward. An integral protective channel 18 is located on ring 10 opposite to stone 12. It comprises one face 20 of ring 10, an integral projection 16 from ring 10, and an integral flat annular segment 14 parallel to face 20. FIG. 3 shows a side view of ring 10 showing the cross-section of the channel. The channel 18 is defined by one face 20 of ring 10, an integral segment 16 and an opposite side 14 parallel to face 20. The ornamented ring 40 is inserted into channel 18 so that either one of the sets of ornamental stones 42, 44 is protected by the channel while the other set is exposed to view.

Figure 4:
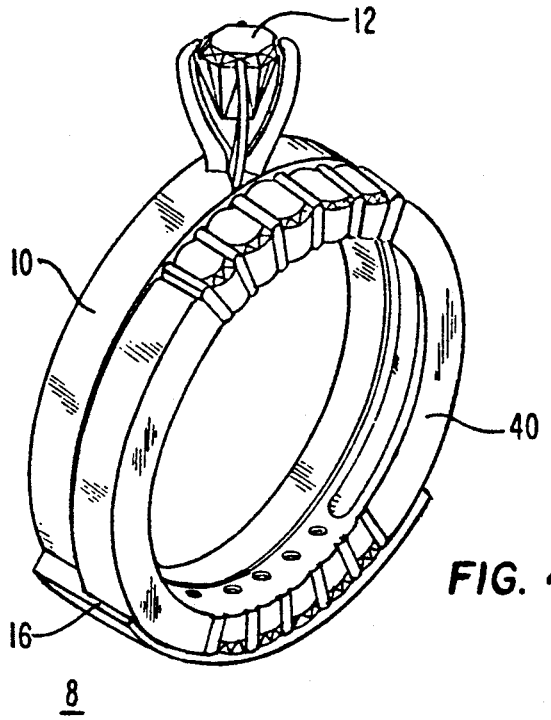
FIG. 4 is a perspective view of an alternate embodiment of the dual ring.
Figure 5:
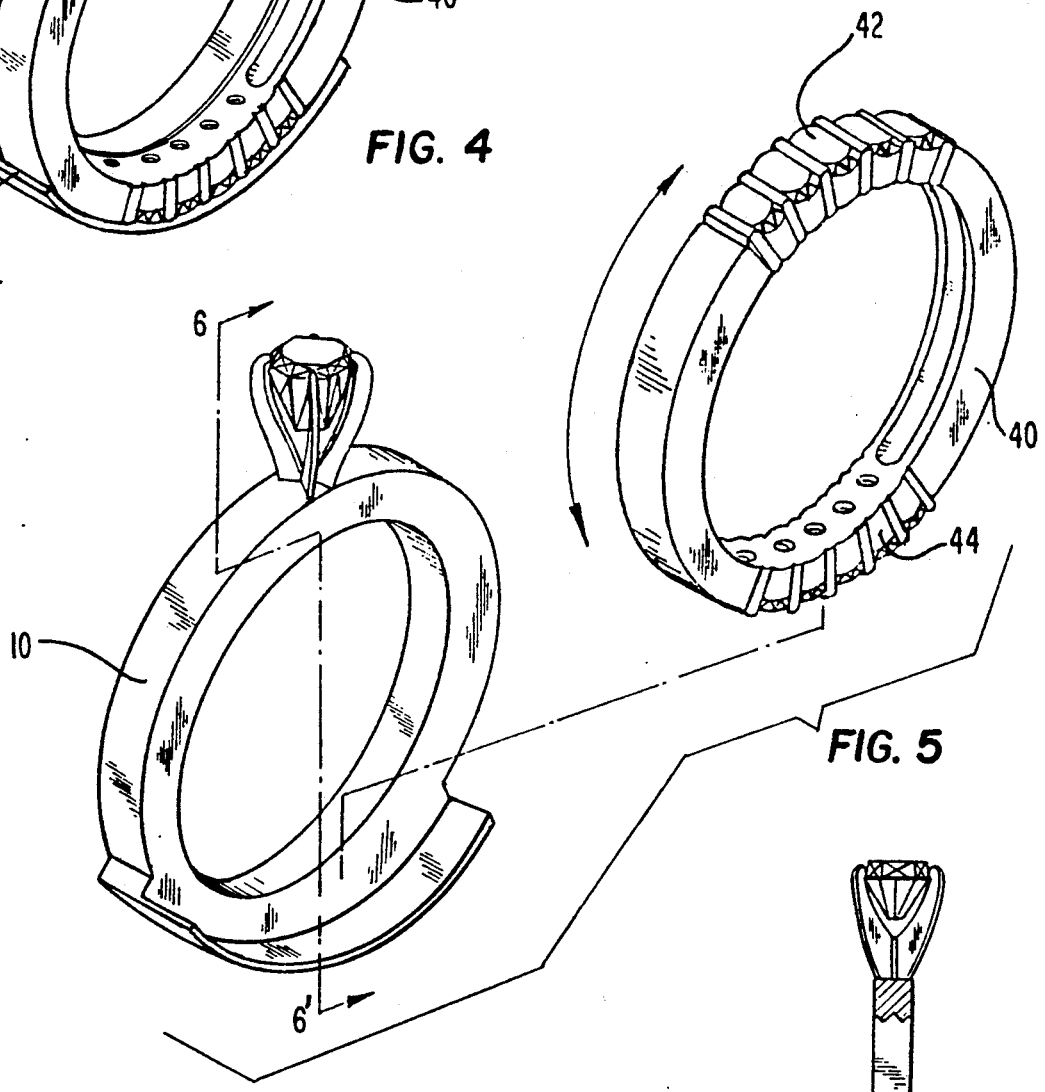
FIG. 5 is an exploded view of the alternate dual ring showing how the rings fit together.
Figure 6:
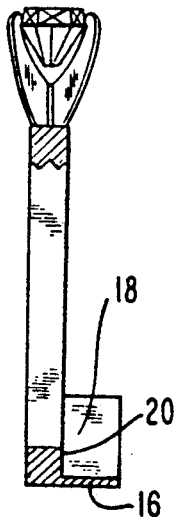
FIG. 6 is a cross-section of the alternate ring with the protector.

An alternative embodiment of the dual ring is shown in FIG. 4. In this embodiment, the protective device for ring 40 is modified by removal of side 14 of channel 18. The innermost set of stones of ring 40 is then protected from abrasion and scratching by the integral projection 16 of ring 10.

It is important to note, in both embodiments, that annular segments 14 and 16 are sized to completely enclose and protect all of the stones in sets 42 and 44 of ring 40; none of the stones remain outside of the protective channel 18. Where the stones occupy a greater portion of the circumference than is shown in both embodiments, the annular channel segment need cover only that fraction of the circumference required to protect the stones from damage, e.g., approximately one-fourth to one-third of the ring circumference.

While the invention has been described by reference to specific embodiments, this was for purposes of illustration only and should not be construed to limit the spirit and scope of the invention. Numerous alternative embodiments and modifications are possible and are considered to be within the scope of the invention.

I claim:

1. A dual ring with protector comprising, a) a first ring, b) a second ring in the shape of an annulus, and c) an annular segment member, integral with said first ring, and having a channel dimensioned to receive said second ring, wherein said second ring includes a first and a second set of ornamental stones, said first set of stones being different from said second set of stones, whereby said first set of stones is received and protected by said channel when said second set of stones is exposed to view, and said second set of stones is received and protected by said channel when said first set of stones is exposed to view.

2. The dual ring of claim 1 wherein said channel has a first and a second parallel side, said first parallel side comprising said first ring and said second parallel side comprising an annular segment integral with said annular segment member.

3. A two-piece dual ring with protector comprising, a first ring having an annular segment member, and a second ring in the shape of an annulus, said annular segment member being integral with and extending as a solid projection from said first ring so as to receive said second ring in an abutting relationship with said first ring, wherein said second ring includes first and second sets of ornamental stones, said first set of stones being received and protected by said annular segment member when said second set of stones is exposed to view, and said second set of stones being received and protected by said annular segment member when said first set of stones is exposed to view.

* * * * *